US006779698B2

(12) United States Patent
Lin

(10) Patent No.: US 6,779,698 B2
(45) Date of Patent: Aug. 24, 2004

(54) ABRASION-RESISTANT BUMPER FOR A NAIL-DRIVING TOOL

(76) Inventor: Hwai-Tay Lin, Akara Building, 24 De Castro Street, Wickhams Cay I, Road Town, Tortola (VG)

( * ) Notice: Subject to any disclaimer, the term of this patent is extended or adjusted under 35 U.S.C. 154(b) by 0 days.

(21) Appl. No.: 09/978,516

(22) Filed: Oct. 15, 2001

(65) Prior Publication Data

US 2003/0071105 A1 Apr. 17, 2003

(51) Int. Cl.[7] ..... B25C 1/04
(52) U.S. Cl. ..... 227/130; 227/10; 173/210
(58) Field of Search ..... 227/10, 130; 473/210; 267/139, 140; 92/85 R

(56) References Cited

U.S. PATENT DOCUMENTS 2,821,170 A * 1/1958 Jacobs ..... 91/20
2,983,922 A * 5/1961 Jiulfs ..... 227/130
3,190,187 A * 6/1965 Doyle ..... 91/403
3,205,787 A * 9/1965 Volkman ..... 91/399
3,387,541 A * 6/1968 Bade ..... 91/461
3,572,211 A * 3/1971 Doyle ..... 91/417 A
3,574,379 A * 4/1971 Jordan ..... 293/109
3,760,695 A * 9/1973 Rothfuss ..... 92/85 R
3,784,182 A * 1/1974 Sobel ..... 267/140
3,807,281 A * 4/1974 Perkins ..... 91/418
3,828,656 A * 8/1974 Biddle et al. ..... 92/85 R
3,969,989 A * 7/1976 Maurer et al. ..... 92/85 R
4,050,505 A * 9/1977 Kemper et al. ..... 164/206
4,558,584 A * 12/1985 Myers ..... 72/407
4,609,135 A * 9/1986 Elliesen ..... 227/130
4,625,903 A * 12/1986 Becht ..... 227/131
4,909,419 A * 3/1990 Yamada et al. ..... 227/1
4,932,480 A * 6/1990 Golsch ..... 173/210
5,617,925 A * 4/1997 Boothby et al. ..... 173/211
6,164,510 A * 12/2000 Deieso et al. ..... 227/130
6,182,881 B1 * 2/2001 Kellner et al. ..... 227/10

* cited by examiner

*Primary Examiner*—Rinaldi I. Rada
*Assistant Examiner*—Paul Durand
(74) *Attorney, Agent, or Firm*—Alan D. Kamrath; Nikolai & Mersereau, P.A.

(57) ABSTRACT

A nail-driving tool includes a cylinder defining a chamber for reciprocatingly receiving a piston. A bumper is received in the chamber and includes a first bumper section and a second bumper section made of a material having a rigidity different from that of the first bumper section. When in a driving stroke of the piston toward the bumper, air in the chamber exits the cylinder via ports of the cylinder.

13 Claims, 4 Drawing Sheets

A-A

ABRASION-RESISTANT BUMPER FOR A NAIL-DRIVING TOOL

BACKGROUND OF THE INVENTION

1. Field of the Invention

The present invention relates to an abrasion-resistant bumper for a nail-driving tool.

2. Description of the Related Art

U.S. Pat. No. 4,932,480 to Golsch issued on Jun. 12, 1990 discloses a pneumatically powered nail-driving tool 10 comprising a cylinder 20, a piston 26 reciprocatingly received in the cylinder 20, and a main valve 60 for driving the piston 26. A driving element 32 is attached to the piston 26 for driving a nail. Movement of the piston 26 is arrested by an air-cooled bumper 70 to thereby provide a cushioning effect. As illustrated in FIGS. 2 through 5 of this patent, the bumper 70 comprises an upper end 100, a lower end 102, an inner peripheral surface 104, and an outer peripheral surface 106. The bumper 70 has an annular flange 108 extending outwardly at its lower end 102. The annular flange 108 fits into the annular recess 82 in the cylindrical wall 24, when the bumper 70 is fitted within the cylinder 20, so as to secure the bumper 70 against the end wall 24. The bumper 70 has eight slots 110 extending radially from the inner peripheral surface 104 and eight slots 112 extending radially from the outer peripheral surface 106. Arrangement of the slots 110 and 112 in the bumper 70 provides a food bumping effect. However, since the bumper 70 is made of a single resilient or elastomeric material, the face of the bumper 70 that is subject to impact of the piston 26 would become soft and thus lose its impact-resisting effect. In addition, breakage tends to occur between the slots 112 and the slots 110. Further, when the upper end 100 of the bumper 70 is subject to the impact from the piston 26, the bumper 70 is already in intimate contact with the cylinder 20 and thus has a low cushioning effect, as there is no room allowing further deformation of the bumper 70. Further, during assembly of the bumper 70, the slots 112 of the bumper 70 must be aligned with the ports 80 in the cylinder 20 in order to assure exhaustion of the air in the space 30 below the piston 26 via the ports 80. Difficulty and inconvenience in the assembly procedure are thus caused.

SUMMARY OF THE INVENTION

An object of the present invention is to provide an abrasion-resistant bumper for a nail-driving tool comprising a cylinder defining a chamber for reciprocatingly receiving a piston. The bumper comprises a first bumper section and a second bumper section made of a material having a rigidity different from that of the first bumper section. When in a driving stroke of the piston toward the bumper, air in the chamber exits the cylinder via ports of the cylinder.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
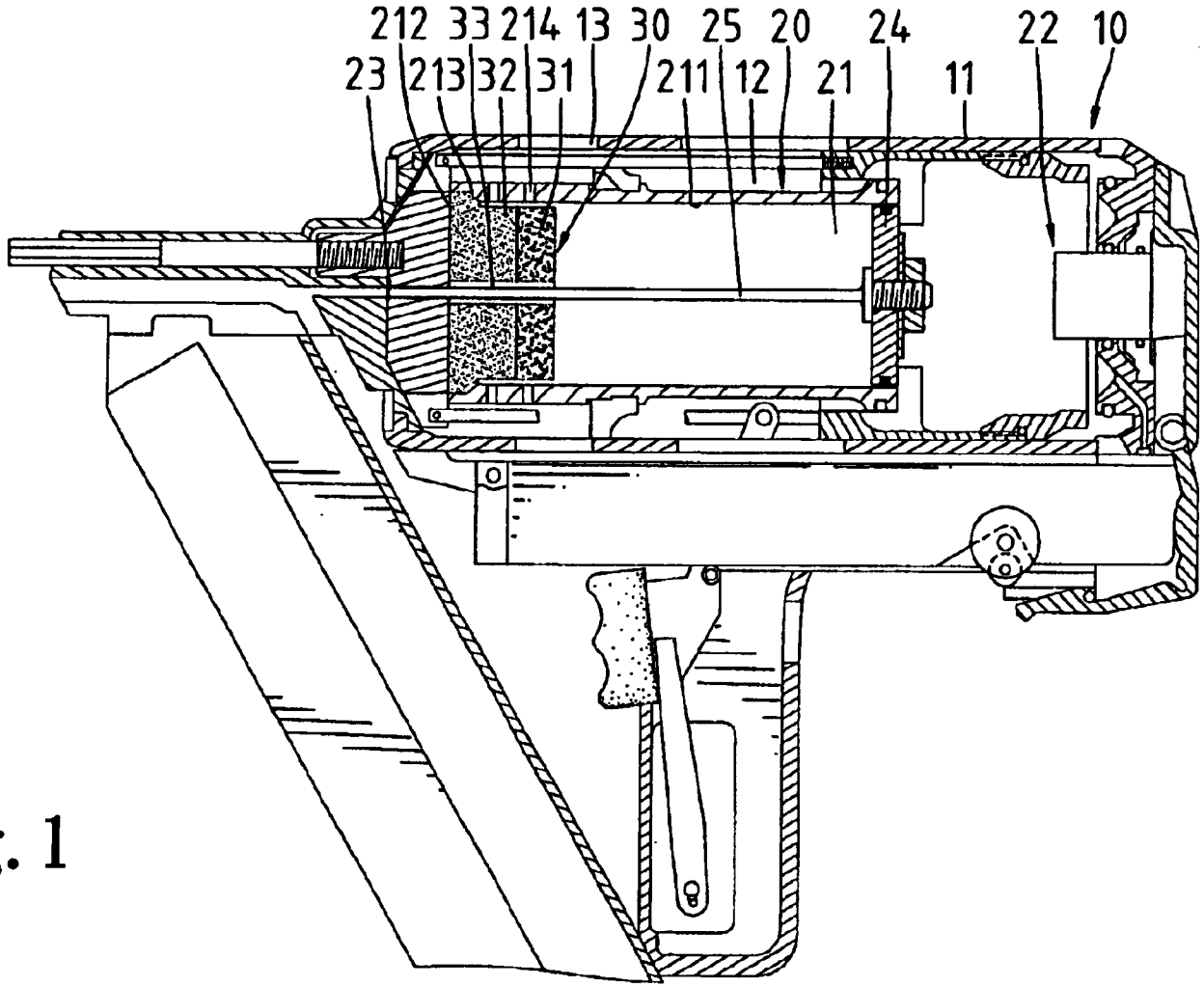
FIG. 1 is a sectional view of a nail-driving tool in accordance with the present invention.

Referring to FIG. 1, a nail-driving tool in accordance with the present invention is designated by 10 and generally comprises a head 11 defining a compartment 12 for receiving a cylinder 20. Plural ports 13 are defined in an end of the head 11 and communicated with the compartment 12.

The cylinder 20 comprises a chamber 21 defined by an inner peripheral wall 211 and an end wall 212. A piston-driving means 22 is mounted in the chamber 21 at a position opposite to the end wall 212. An example of the piston-driving means 22 comprises pressurized air or inflammable gas. An annular connecting wall 213 is provided to interconnect the end wall 212 with the inner peripheral wall 211. The annular connecting wall 213 has across sectional size larger than that of the inner peripheral wall 211. A through-hole 23 defined in a central portion of the end wall 212. Further, plural ports 214 are defined in the inner peripheral wall 211 and communicated with the compartment 12.

A piston 24 is reciprocatingly received in the chamber 21 and drivable by the piston-driving means 22. A driving element 25 is securely attached to a middle of the piston 24 and extends along a moving direction of the piston 24 to pass through the through-hole 23 in the end wall 212.

Figure 2A:
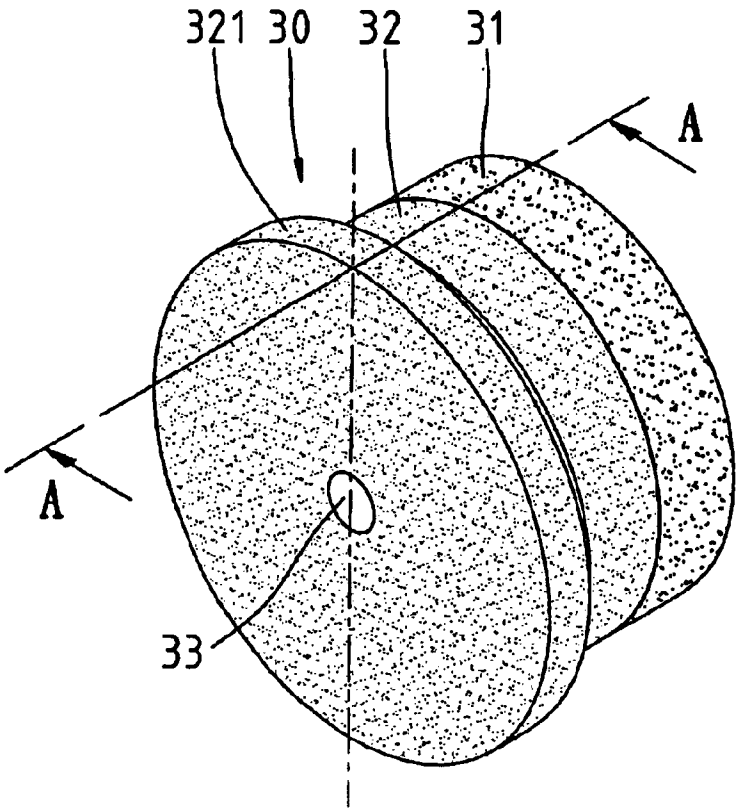
FIG. 2A is a perspective view of a bumper of the nail-driving tool in accordance with the present invention.
Figure 2B:
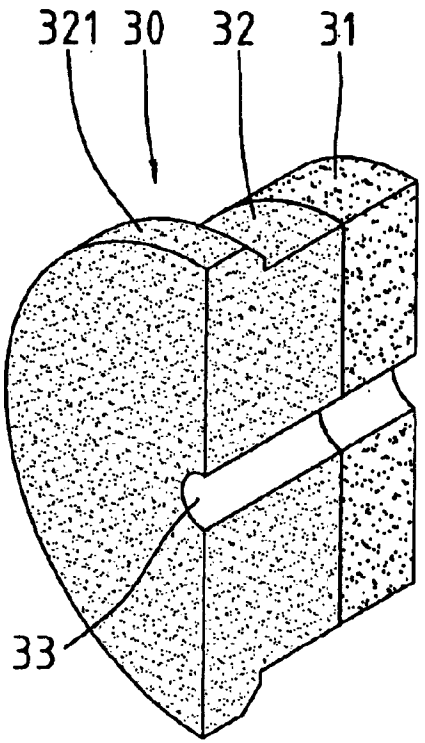
FIG. 2B is a perspective view of the bumper cutting from plane A—A in FIG. 2A.

A bumper 30 is securely mounted in an end of the chamber 21 of the cylinder 20. As illustrated in FIGS. 2A and 2B, the bumper 30 comprises a first bumper section 31 and a second bumper section 32 made of a material that is less rigid than that of the first bumper section 31. The second bumper section 321 includes an enlarged end section 32 that abuts against the end wall 212 and that is securely received in a space defined by the annular connecting wall 213 of the cylinder 20. Further, the remaining portion of the bumper 30 is not in contact with the inner peripheral wall 211 of the cylinder 20, thereby providing a gap therebetween. The bumper 30 has a central through-hole 33 extending through the first bumper section 31 and the second bumper section 32 and aligning with the through-hole 23 in the end wall 212. As illustrated in FIG. 1, the driving element 25 extends through the through-hole 23 in the end wall 212 of the cylinder 20 and the through-hole 33 in the bumper 30.

Figure 3:
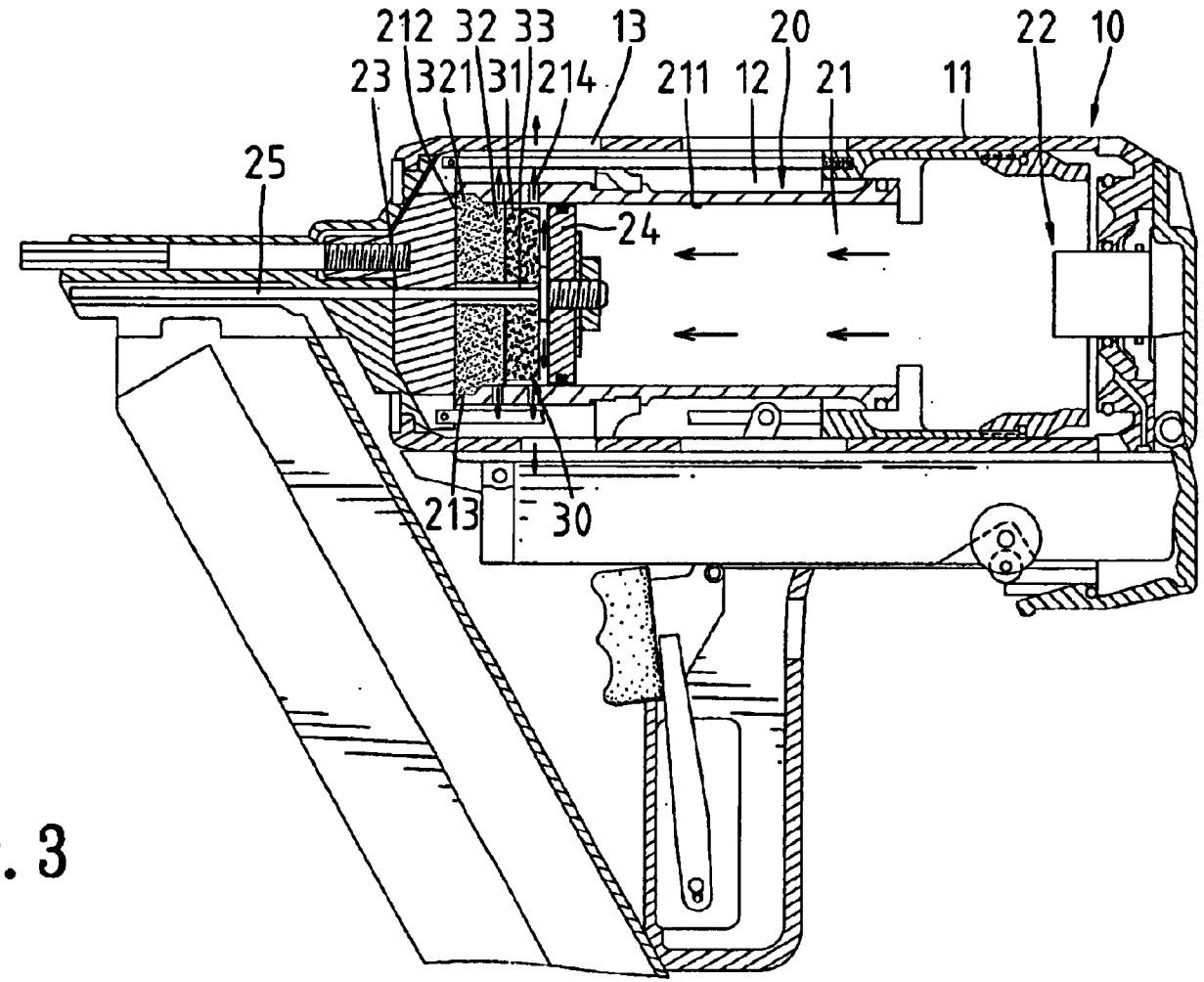
FIG. 3 is a sectional view similar to FIG. 1, illustrating a driving stroke of the nail-driving tool.

When in a driving stroke of a nail, referring to FIG. 3, the piston 24 driven by the piston-driving means 22 slides toward the end of the chamber 21 such that the driving element 25 is moved out of the through-hole 23 of the end wall 212 to impact a nail (not shown). A joint area between the piston 24 and the driving element 25 impacts the first bumper section 31 of the bumper 30. Since the first bumper section 31 is more rigid, it provides an excellent abrasion resistance to prevent abrasion of the bumper 30. Since a gap is defined between the inner peripheral wall 211 of the cylinder 20 and the bumper 30 (except the enlarged end section 321 of the second bumper section 32), the second bumper section 32 may deform properly in response to the impact from the piston 24. The air in the chamber 21 exits the cylinder 20 via the ports 214 of the cylinder 20 and the ports 13 of the head 11.

Figure 4:
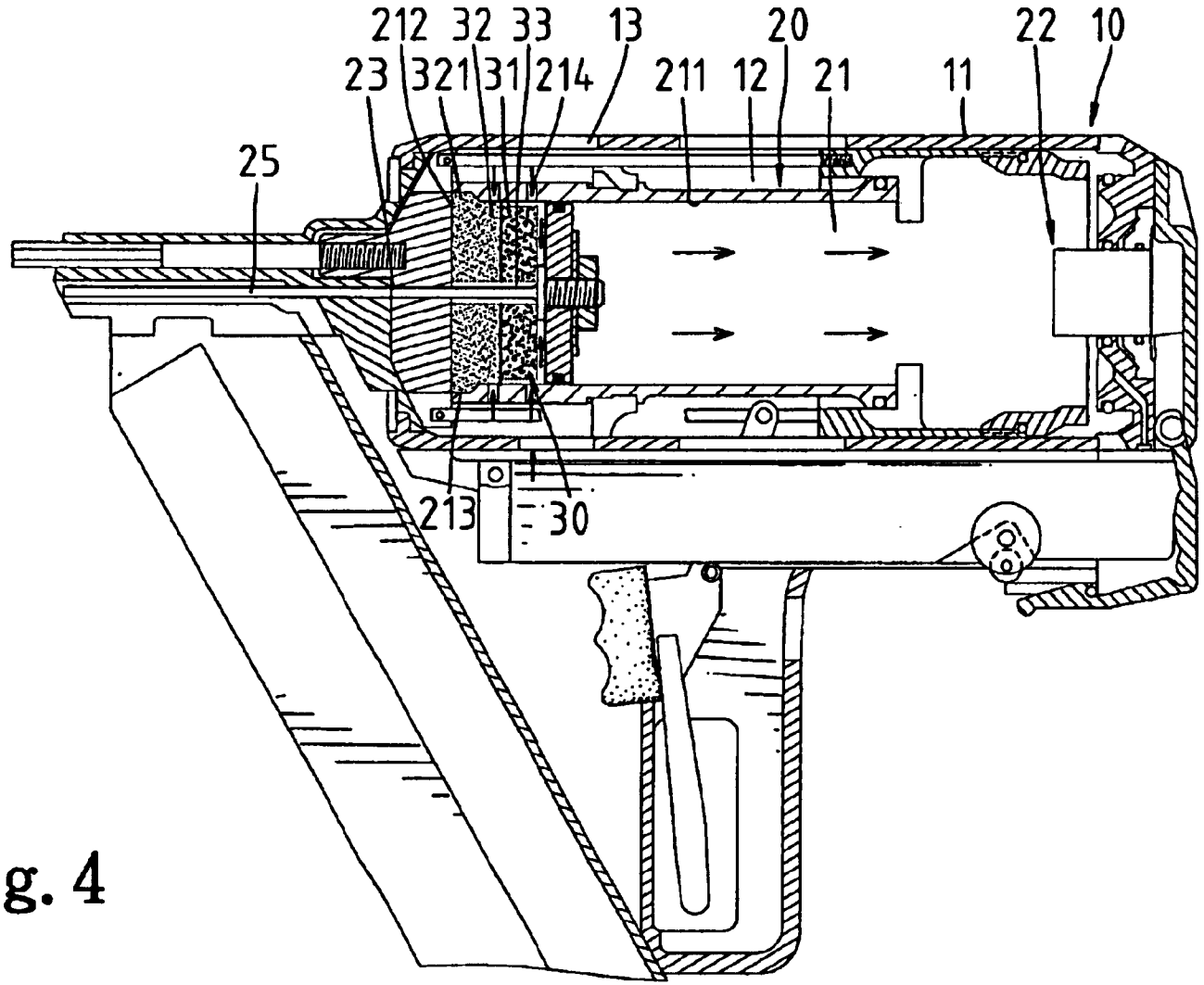
FIG. 4 is a sectional view similar to FIG. 1, illustrating a return stroke of the nail-driving tool.

After driving the nail, the piston 24 returns to its initial position. Ambient air enters the compartment 12 via the ports 13 of the head 11 and then enters the chamber 21 of the cylinder 20 via the ports 214, as shown in FIG. 4.

According to the above description, it is appreciated that the bumper 30 in accordance with the present invention is more resistant to abrasion while providing the cushioning effect for the piston 24. This is owing to the first bumper section 31 and the second bumper section 32 having different rigidities. The gap between the bumper 30 and the inner peripheral wall 211 of the cylinder 20 allows air in the chamber 21 to exit the cylinder 20 during the driving stroke and allows ambient air to enter the chamber 21 of the cylinder 20 during the return stroke. It is not necessary to drill holes in the bumper 30, and the troublesome assembly procedure of aligning the holes of the bumper with the ports of the cylinder in prior art is thus avoided.

Although the invention has been explained in relation to its preferred embodiment, it is to be understood that many other possible modifications and variations can be made without departing from the scope of the invention as hereinafter claimed.

What is claimed is:

1. A nail-driving tool comprising:

a cylinder comprising a chamber defined by an inner peripheral wall and an end wall, the end wall including a through-hole, the inner peripheral wall including plural ports communicated with outside;

a piston reciprocatingly received in the chamber of the cylinder;

a driving element securely attached to the piston to move therewith, the driving element extending through the through-hole of the end wall;

a bumper received in the chamber and located between the piston and the end wall, the driving element extending through the bumper, with the bumper including a first bumper section having an outer periphery; and an annular gap extending completely around the inner peripheral wall of the cylinder and between the inner peripheral wall of the cylinder and the outer periphery of the first bumper section of the bumper, with the annular gap having an axial extent along the driving element, with the outer periphery of the first bumper section not being in contact with the inner peripheral wall of the cylinder and located around the driving element, with the plural ports located within the axial extent of the annular gap, with the annular gap being in communication with the plural ports, the annular gap allowing exit of the air in the chamber via the plural ports of the cylinder and allowing entrance of ambient air into the chamber of the cylinder via the plural ports of the cylinder located within the axial extent of the annular gap, with the bumper further comprising a second bumper section made of a material having a rigidity different from that of the first bumper section, with the driving element extending through the first bumper section and the second bumper section, with the second bumper section including an enlarged end section that abuts against the end wall, with the enlarged end section of the second bumper section having a cross sectional size perpendicular to the driving element having a radial extent larger than that of the annular gap.

2. The nail-driving tool as claimed in claim 1, further comprising means for driving the piston, said piston-driving means being one of pressurized air and inflammable gas.

3. The nail-driving tool as claimed in claim 1, further comprising:

a head, with the cylinder mounted in the head, wherein the head comprises plural ports in an end thereof to allow communication between the chamber of the cylinder and outside.

4. The nail-driving tool as claimed in claim 1, further comprising:

a head, with the cylinder mounted in the head.

5. The nail-driving tool as claimed in claim 1, with the second bumper section including a first portion of a cross sectional size perpendicular to the driving element, with the second bumper section including the enlarged end section extending from the first portion and of a cross sectional size perpendicular to the driving element larger than the cross sectional size of the first portion, with a cross sectional shape of the second bumper section parallel to the driving element being in the form of a T.

6. The nail-driving tool as claimed in claim 1, with the enlarged end section being of a larger cross sectional size than the outer periphery of the first bumper section of the bumper not in contact with the inner peripheral wall of the cylinder, with the nail-driving tool further comprising an annular connecting wall being defined between the end wall and the inner peripheral wall, the enlarged end section of the bumper being securely received in a space defined by the annular connecting wall.

7. The nail-driving tool as claimed in claim 6, wherein the annular connecting wall has a cross-sectional size larger than that of the inner peripheral wall of the cylinder, thereby defining the annular gap between the inner peripheral wall of the cylinder and the outer periphery of the first bumper section of the bumper not in contact with the inner peripheral wall of the cylinder.

8. The nail-driving tool as claimed in claim 7, further comprising means for driving the piston, said piston-driving means being one of pressurized air and inflammable gas.

9. The nail-driving tool as claimed in claim 7, further comprising:

a head, with the cylinder mounted in the head, wherein the head comprises plural ports in an end thereof to allow communication between the chamber of the cylinder and outside.

10. The nail-driving tool as claimed in claim 7, wherein the first bumper section is more rigid than the second bumper section.

11. The nail-driving tool as claimed in claim 7, wherein the annular gap is defined between the second bumper section and the inner peripheral wall of the cylinder.

12. The nail-driving tool as claimed in claim 11, further comprising means for driving the piston, said piston-driving means being one of pressurized air and inflammable gas.

13. The nail-driving tool as claimed in claim 11, further comprising:

a head, with the cylinder mounted in the head, wherein the head comprises plural ports in an end thereof to allow communication between the chamber of the cylinder and outside.

* * * * *